US005882242A

United States Patent [19]

Hardy

[11] Patent Number: 5,882,242

[45] Date of Patent: Mar. 16, 1999

[54] PROTECTIVE GARMENT

[76] Inventor: Robert E Hardy, 4 Dearfield Rd., Greenich, Conn. 06480

[21] Appl. No.: 955,687

[22] Filed: Oct. 22, 1997

[51] Int. Cl.[6] ..... A41C 3/00; A41D 27/00

[52] U.S. Cl. ..... 450/93; 450/1; 2/73; 2/463; 2/243.1; 52/252; 52/255; 52/901; 250/516.1

[58] Field of Search ..... 2/73, 455, 456, 2/463, 2.5, 243.1, 85, 105, 106, 109, 110, 69, 69.5, 113, 114, 115; 450/1, 93; 57/901, 252, 255, 257; 250/515.1, 516.1

[56] References Cited

U.S. PATENT DOCUMENTS 3,986,530 10/1976 Maekawa .
4,590,623 5/1986 Kitchman .
5,690,537 11/1997 Kalmus .

*Primary Examiner*—Jeanette Chapman
*Attorney, Agent, or Firm*—Patrick J. Walsh

[57] ABSTRACT

A shielding brassiere fabricated of a soft supple material such as cotton interwoven with stainless steel threads to shield and screen the breast from electromagnetic radiation.

3 Claims, 1 Drawing Sheet

PROTECTIVE GARMENT

BACKGROUND OF THE INVENTION

The present invention relates to protective garments and particularly to protection against potential carcinogenic effects of electromagnetic radiation.

This year breast cancer will be diagnosed in approximately 180,000 women, and about 40,000 will die of the disease. Breast cancer is the second most common type of cancer in women, and is the leading cause of death for women of age 35–55 years.

Over the last fifty years the increase of breast cancer has risen steadly by 2 percent annually in most industralized nations. In America alone from 1973 to 1988, the rate rose 26 percent. It is now documented that American women have a one-in-eight chance of developing breast cancer sometime during their lives.

One factor identified as a potential causative agent is electromagnetic field radiation. Our bodies are exposed to a constant bombardment from electromagnetic radiation of various frequencies and intensities. Many studies have expressed the concern that the increased incidence of breast cancer may be related to the tremendous increase in ambient electromagnetic radiation to which the human body, specifically the breast, is exposed. This electromagnetic radiation is generated by microwave ovens, radio frequencies, computers, fax machines, copiers, printers, mobile cellular phones, overhead utility lines, and television to name just a few.

The matter of an association between exposure to power frequency magnetic fields and breast cancer has been the subject of epidemiological studies. That the body absorbs electromagnetic radiation has been proven without question, creating a problem as to what are safe exposure levels. The human body has an electromagnetic permeability almost identical to air and therefore electromagnetic radiation is readily absorbed.

Attempts have been made to establish guidelines and safe exposure standards as to how much radiation the body can safely absorb. Herman Scwan, a biophysicist at the University of Pennsylvania's Moore School of Engineering, stated that the net effect of absorbed radiation is twenty times greater than the body can dissipate. Human tissue most effectively absorbs radiation around 87 mHz in the FM radio band and reaches a maximum absorption at between 87 and 300 mHz. This range encompasses frequencies spanning FM radio and very high frequency (VHF) broadcasting (Levitt). A television set functions through the use of electron guns aimed from inside the set toward the screen or directly at the viewer, generating a high electromagnetic field of radiation. Computers are multi-frequency devices that generate an electromagnetic field from a cathode ray tube.

All of these are artificially created frequencies. None of these existed in the natural world before the twentieth century (Levitt). The high frequencies used for radio, television, radar, and cellular telephone transmission are sometimes on the order of a billion times more powerful than what exists in nature (Levitt).

No one understands the mechanism for the uncontrolled growth of cancer cells, however, in glandular tissue like the breast, electromagnetic radiation may be a co-factor in promoting cancer or a co-producer of cancer in combination with other carcinogens. Many researchers consider electromagnetic radiation to be a cancer promoter at the very least, if not an outright initiator (Levitt).

Mevissen et al reported that electromagnetic radiation exposure promotes the growth and progression of mammary tumors in rats. The data thus add to the accumulating evidence that electromagnetic field radiation exerts possible cancer coproducing effects. (Carcinogenesis, January 1995).

Stevens et al in Environmental Health Perspectives (March, 1996) reported that the effect of electrical power on breast cancer would have profound implications and the possibility deserves continued investigation.

Li et al published such an appraisal in Occupational Environmental Medicine (Aug. 1996) and concluded that more studies are needed. The authors also suggest that the risk of female breast cancer should be the object of additional investigations and that future studies should attempt to include information on exposure to magnetic fields from workplaces as well to estimate the effects of overall exposure to magnetic fields.

Medical research thus has identified a potential breast cancer causing environmental hazard and stresses the need for additional qualified research to ascertain whether electromagnetic radiation causes or acts as a coproducer of breast cancer. Until such research is accomplished and these issues are resolved, it is essential that this potential hazard of electromagnetic field radiation and its relationship to the cause of breast cancer be dealt with.

The present invention deals with this potential electromagnetic field hazard particularly the residential and workplace hazards involving electromagnetic field radiation emanating from commonly used electrical appliances including computer monitors to name just a few possible causes of breast cancer.

SUMMARY OF THE INVENTION

The present invention is a brassiere that provides screening and shielding of the breast from the potential hazards of electromagnetic radiation which may promote or coproduce breast cancer in women. The brassiere provides for screening and shielding electromagnetic radiation emanating from residential and workplace hazards previously mentioned.

The brassiere according to the invention is fabricated of cotton interwoven with stainless steel threads to provide a fabric that provides shielding and screening from electromagnetic radiation. The shielding and screening fabric of the brassiere provides a comfortable and unobtrusive shield against electromagnetic radiation. The garment is malleable, soft, lightweight, fashionable, and can be made to standardized size requirements.

OBJECTS OF THE INVENTION

An object of the invention is to provide a screening garment to shield the female breast from the direct effect and exposure of the potential carcinogenic hazard of electromagnetic radiation.

Another object of the invention is to provide a shielding brassiere particularly suited for protection against electromagnetic radiation emanating from appliances such as a cathode ray computer monitor, television, cellular phones, hair dryers, and microwave ovens.

Another object of the invention is to provide a brassiere fabricated of a suitable material such as cotton and interwoven with a protective shield against electromagnetic radiation.

Another object of the invention is to provide a brassiere fabricated of a suitable material such as cotton and interwoven with stainless steel threads as a protective shield against electromagnetic radiation.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which:

FIG. 1 is a perspective view of a brassiere fabricated according to the invention.

DETAILED DESCRIPTION OF THE PREFERRED EMBODIMENT

Figure 1:
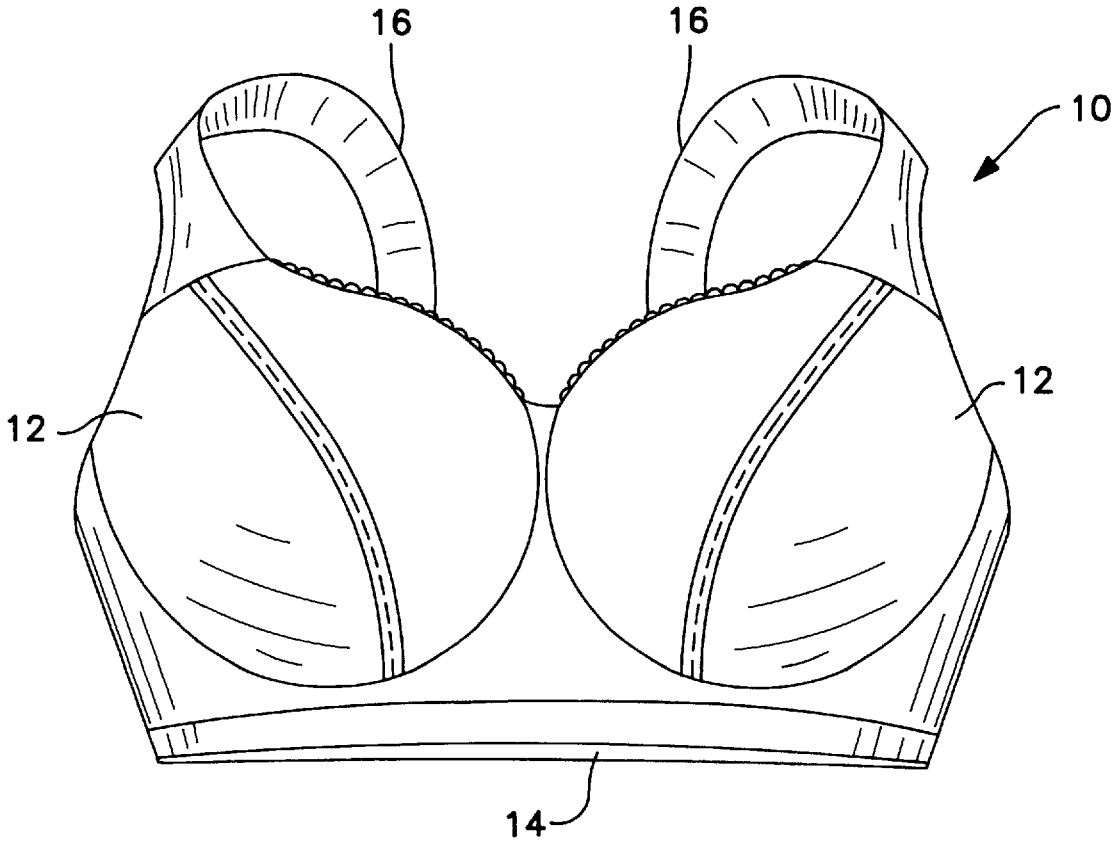

Referring to the drawing, a brassiere 10 according to the invention is fabricated in a usual style including cups 12, encircling band 14 and shoulder straps 16.

Except for decorative trim and elastic strap components, the brassiere is fabricated entirely of a supple material such as cotton interwoven with stainless steel fiber. Preferably, the material used is interwoven with an 8 u stainlesssteel and is available commercially from Finex Handels GMBH of Munich.

The brassiere provides shielding of the breasts from electromagnetic radiation of 18.5 dB to 39 dB at frequencies of 200 MHz to 10 GHz as documented by Research Laboratories of Instrument Specialties Company, Inc.

As stated, office personnel spend a considerable portion of the working day in front of a cathode ray computer. Homemakers, and women in other businesses are near appliances that cause the breast to be bombarded with electromagnetic radiation with the potential for promoting, or coproducing breast cancer. By wearing a brassiere fabricated in accordance with the invention, women are provided shielding against these environmental hazards.

Various changes may be made to the structure embodying the principles of the invention. The foregoing embodiments are set forth in an illustrative and not in a limiting sense. The scope of the invention is defined by the claims appended hereto.

I claim:

1. A brassiere having cups, an encircling band, and shoulder straps, the brassiere being fabricated of cotton fabric interwoven with stainless steel thread shielding electromagnetic radiation emanating from a computer monitor in the range of 18.5 dB to 39 dB at frequencies of 200 MHz to 10 GHz.

2. A brassiere as defined in claim 1 in which the basic fabric includes 8u stainless steel threads.

3. A brassiere having cups, an encircling band and shoulder straps, the cups, encircling band and shoulder straps fabricated of cotton fabric interwoven with 8u stainless steel threads in a brassiere that is comfortable, unobtrusive, malleable, soft, lightweight and fashionable and that shields electromagnetic radiation emanating from a computer monitor and multiple other sources in the environment.

* * * * *